US007425923B2

(12) United States Patent
Ko et al.

(10) Patent No.: US 7,425,923 B2
(45) Date of Patent: Sep. 16, 2008

(54) COMBINED DMB AND MOBILE COMMUNICATION ANTENNA APPARATUS FOR MOBILE COMMUNICATION TERMINAL

(75) Inventors: Yun-Kyoung Ko, Seoul (KR); Hyu-Myung Jeon, Seongnam-si (KR); Yue-Il Youn, Anyang-si (KR); Tae-Hui Cho, Gunpo-si (KR); Dae-Chul Kang, Suwon-si (KR); Jung-Cheon Choi, Seoul (KR)

(73) Assignee: Samsung Electronics Co., Ltd. (KR)

( * ) Notice: Subject to any disclaimer, the term of this patent is extended or adjusted under 35 U.S.C. 154(b) by 45 days.

(21) Appl. No.: 11/236,285

(22) Filed: Sep. 27, 2005

(65) Prior Publication Data

US 2006/0220967 A1 Oct. 5, 2006

(30) Foreign Application Priority Data

Mar. 31, 2005 (KR) ..... 10-2005-0027419

(51) Int. Cl.
*H01Q 1/24* (2006.01)

(52) U.S. Cl. ..... 343/702; 343/901

(58) Field of Classification Search ..... 343/702, 343/900, 901

See application file for complete search history.

(56) References Cited

U.S. PATENT DOCUMENTS

| | | | | |
|---|---|---|---|---|
| 6,288,681 | B1 * | 9/2001 | Kim et al. | 343/702 |
| 6,317,086 | B1 * | 11/2001 | Woo | 343/702 |
| 6,369,764 | B1 * | 4/2002 | Ishikawa | 343/702 |
| 6,476,768 | B2 * | 11/2002 | Woo et al. | 343/702 |
| 7,023,388 | B2 * | 4/2006 | Shimabara | 343/702 |
| 2002/0008664 | A1 * | 1/2002 | Bark et al. | 343/700 MS |

FOREIGN PATENT DOCUMENTS

| | | |
|---|---|---|
| EP | 1617564 | 1/2006 |
| WO | WO 2004/093334 | 10/2004 |

* cited by examiner

*Primary Examiner*—HoangAnh T Le
(74) *Attorney, Agent, or Firm*—The Farrell Law Firm, P.C.

(57) ABSTRACT

Disclosed is a combined DMB and mobile communication antenna apparatus for a mobile communication terminal. The antenna apparatus includes one whip antenna for receiving both signals in a DMB frequency band and in a mobile communication frequency band, a first contact coupled to the whip antenna to receive the signal in the mobile communication frequency band from the whip antenna, and a second contact located under the first contact within a terminal main body and coming in contact with the whip antenna at a lower end of the whip antenna to receive the signal in the DMB frequency band when the whip antenna is drawn out.

3 Claims, 4 Drawing Sheets

COMBINED DMB AND MOBILE COMMUNICATION ANTENNA APPARATUS FOR MOBILE COMMUNICATION TERMINAL

PRIORITY

This application claims priority to an application entitled "Combined DMB and Mobile Communication Antenna Apparatus for Mobile Communication Terminal" filed in the Korean Industrial Property Office on Mar. 31, 2005 and assigned Serial No. 2005-27419, the contents of which are incorporated herein by reference.

BACKGROUND OF THE INVENTION

1. Field of the Invention

The present invention relates to an antenna apparatus for a mobile communication terminal such as a Personal Communication Service (PCS) terminal, a cellular phone and so forth, and more particularly to an antenna apparatus capable of receiving a Digital Media Broadcasting (DMB) signal as well as a phone call signal for general voice transmission/reception.

2. Description of the Related Art

Mobile communication terminals have recently become popular, and with their popularity, a desire to develop complex mobile communication terminals to which, aside from a simple phone call function, various functions for satisfying consumers' needs are added has arisen. Other than the existing voice phone call, additional services desired by users include, for example, a Video On Demand (VOD) function, a video calling function, a digital camera function, an Internet browsing function, a digital broadcasting viewing function and the like.

Of the various additional services stated above, the digital broadcasting service may be divided into a satellite digital broadcasting service and a terrestrial digital broadcasting service. The satellite digital broadcasting service mainly aims at a mobile-type service, and enables users to view multichannel broadcasting anytime and anywhere through portable receivers (e.g., cellular phones, PCS terminals, etc.) or vehicle receivers capable of receiving satellite signals.

The concept of the terrestrial digital broadcasting, which is similar to Digital Audio Broadcasting (DAB), uses an unassigned channel, such as Very High Frequency (VHF) channel no. 12, for broadcasting multimedia for reception by mobile communication terminals. The terrestrial digital broadcasting service refers to a service in which television broadcasting, radio broadcasting and data broadcasting can be transmitted and/or received using a multi-channel.

At present, with the advancement of digital broadcasting and mobile communication technologies, a digital broadcasting service for enabling users to view digital broadcasting while moving such as a DMB service using a mobile communication network, is being developed.

A mobile communication terminal, which has a function for receiving DMB signals using a mobile communication network, not only has a mobile phone function, but can also display DMB programs by means of the mobile communication terminal's display device. Such a mobile communication terminal having the DMB function includes at least two radio signal processing units because a frequency band required for its inherent voice and data transmission/reception functions is different from a DMB frequency band, and thus has a phone mode, a standby mode and a DMB mode serving as both the standby mode and a video receiving mode. In mobile communication terminals, it is common that an antenna for DMB signal reception is connected to an internal tuner and an antenna for voice signal transmission/reception is connected to a duplexer.

However, since the mobile communication terminal having the DMB function must receive DMB signals as well as signals for general voice transmission/reception, it has two antenna apparatuses for receiving the two types of signals, respectively and other components related to the two antenna apparatuses, and thus its structure becomes more complicated than that of a ordinary mobile communication terminal having only a voice phone call function. In other words, the two antenna apparatuses, that is, an antenna apparatus for receiving DMB signals and a communication antenna apparatus are separately mounted to a single body of the mobile communication terminal, which makes the miniaturization of the body of the mobile communication terminal more difficult.

Moreover, due to the fact that the DMB antenna apparatus and the communication antenna apparatus are mounted to a single body of the mobile communication terminal, the mobile communication device may not be as portable as a mobile communication terminal having a single antenna. This is because both the DMB antenna apparatus and the communication antenna apparatus are constructed as retractable antenna apparatuses, and thus the respective antenna apparatuses protrude from the body of the mobile communication terminal. Here, the retractable antenna apparatus refers to an antenna apparatus such as a well-known whip or rod antenna.

SUMMARY OF THE INVENTION

Accordingly, the present invention has been made to solve at least the above-mentioned problems occurring in the prior art, and an object of the present invention is to provide a combined Digital Multimedia Broadcast (DMB) and mobile communication antenna apparatus for a mobile communication terminal, which provides miniaturization and mobility of the terminal by integrating a DMB antenna and a mobile communication antenna together.

In order to accomplish this object, there is provided a combined DMB and mobile communication antenna apparatus for a mobile communication terminal, the apparatus including a whip antenna for receiving signals in a DMB frequency band and for receiving signals in a mobile communication frequency band; a first contact being coupled to the whip antenna to receive the signal in the mobile communication frequency band from the whip antenna; and a second contact being provided under the first contact within a terminal main body and being coupled with the whip antenna at a lower end of the whip antenna to receive the signal in the DMB frequency band when the whip antenna is extended.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Figure 1A:
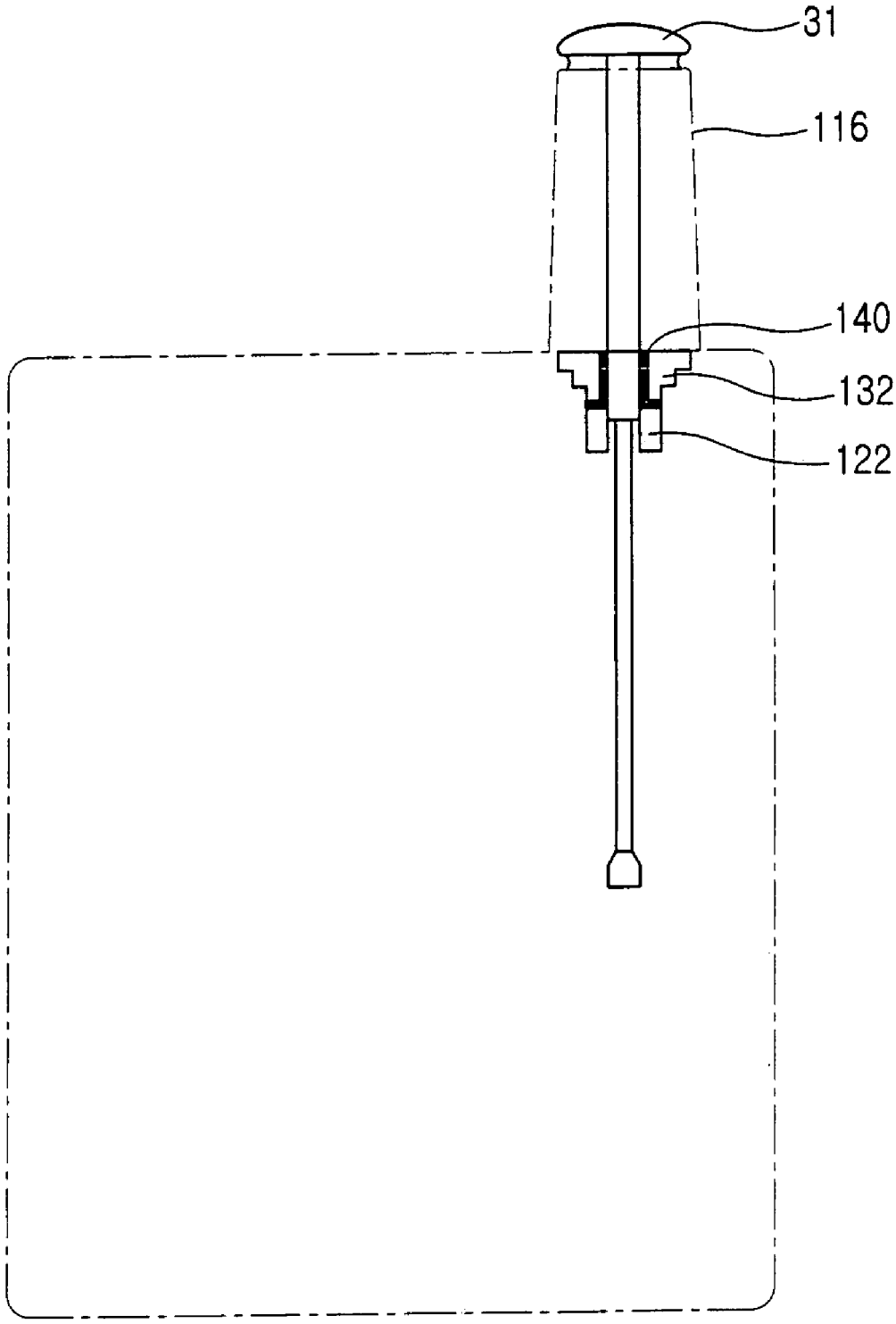
FIGS. 1A and 1B are illustrations showing a planar structure of a combined DMB and mobile communication antenna apparatus for a mobile communication terminal in accordance with a preferred embodiment of the present invention.

Hereinafter, preferred embodiments of the present invention will be described with reference to the accompanying drawings. It should be noted that the similar components are designated by similar reference numerals although they are illustrated in different drawings. Also, in the following description, a detailed description of known functions and configurations incorporated herein will be omitted when it may obscure the subject matter of the present invention.

Figure 1B:
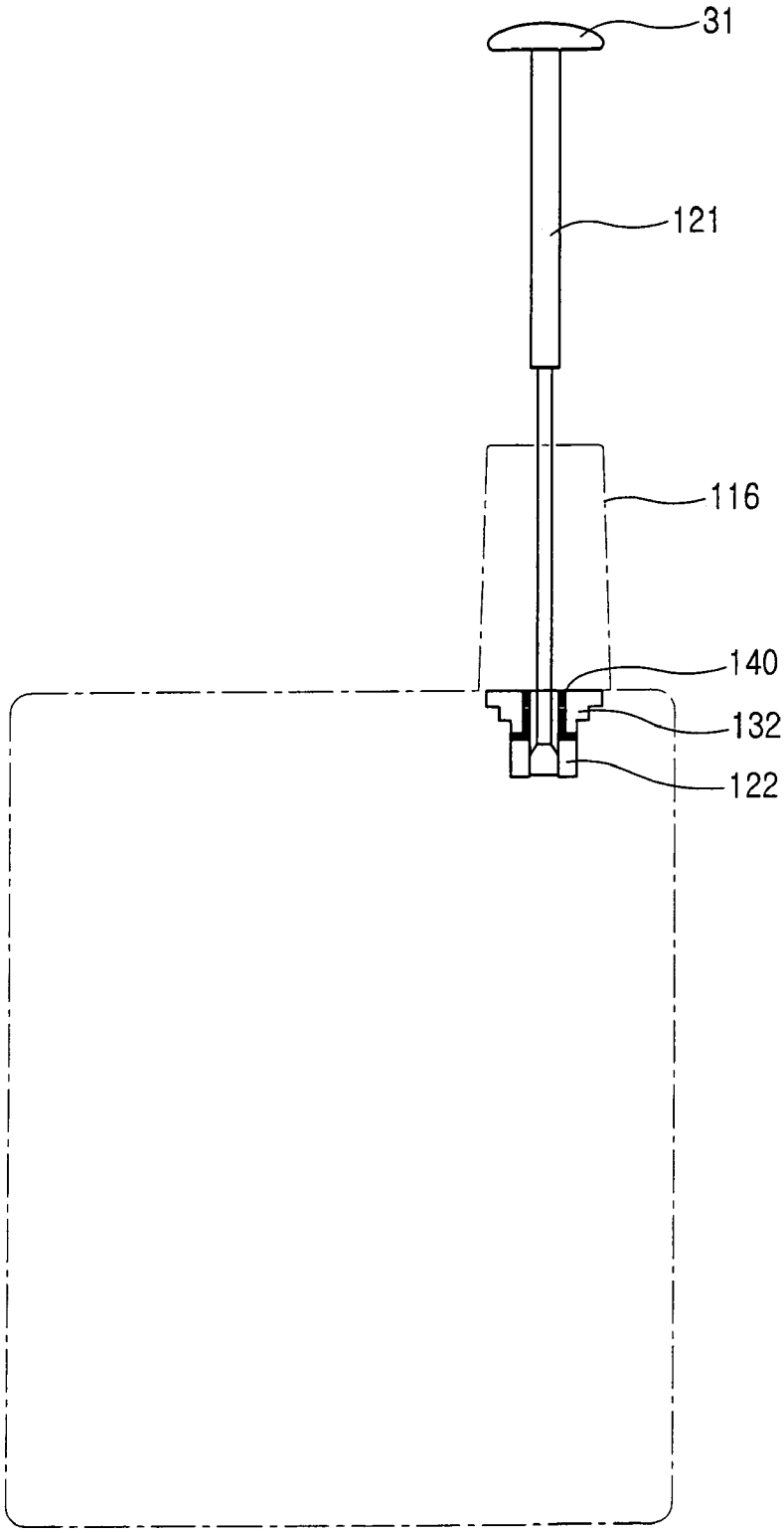

FIGS. 1A and 1B illustrate a planar structure of a combined DMB and mobile communication antenna apparatus for a mobile communication terminal in accordance with a preferred embodiment of the present invention. FIG. 1A shows a whip antenna of the antenna apparatus in a state of being pushed (i.e., withdrawn) into a terminal main body of the mobile communication terminal. FIG. 1B shows the whip antenna in a state of being drawn out (i.e., extended) of the terminal main body.

Referring to FIGS. 1A and 1B, the antenna apparatus 100 according to the present invention is provided in an upper portion of the mobile communication terminal. The antenna apparatus 100 includes a whip antenna 121 for receiving both signals in a DMB frequency band and in a mobile communication (e.g., a PCS) frequency band, a first contact 132 which is connected to the whip antenna 121, not by means of direct contact therewith, but in a coupling manner and receives the signal in the mobile communication frequency band from the whip antenna 121, and a second contact 122 which is located under the first contact 132 within the terminal main body and contacts a lower end of the whip antenna 121 at to transmit the signal in the DMB frequency band to a DMB tuner (designated by reference numeral 50 in FIG. 3) when the whip antenna 121 is drawn out of the terminal main body.

In the antenna apparatus having such a structure, the whip antenna 121 is pushed into/drawn out of a housing 116 attached to the terminal main body, and receives the DMB signal and the mobile communication signal. When the whip antenna 121 is drawn out of the housing 116, the second contact 122 comes in contact with the whip antenna 121 (as shown in FIG. 1B), thereby transmitting the DMB signal to the DMB tuner 50. That is, if the whip antenna 121 is drawn out of the housing 116, the DMB signal is received through the whip antenna 121 and the received DMB signal is transmitted to the DMB tuner 50 via the second contact 122 as shown in FIG. 1B.

In contrast, if the whip antenna 121 is pushed into the terminal main body, the whip antenna 121 receives the mobile communication signal, and the received mobile communication signal is transmitted to an RF unit 21 via the first contact 132 as shown in FIG. 1*a*. In addition, an inner fixing housing 140 shown in FIGS. 1*a* and 1*b* is interposed between the first contact 132 and the second contact 122 to locate the first contact 132 in a proper position relative to the whip antenna 121 and the second contact 122. Through such a construction, the whip antenna 121 is connected to the first contact 132 not by means of direct contact but in a coupling manner when used for the mobile communication antenna.

As shown in FIGS. 1A and 1B, two antenna contacts, one for DMB and the other for mobile communication (PCS), are used in present invention. That is, the two antenna contacts are used as a terrestrial DMB band antenna and a PCS band antenna, respectively. As also shown in FIGS. 1A and 1B, the terrestrial DMB band antenna is realized by using the second contact 122 located under the first contact 132 in such a manner that it establishes a connection to the whip antenna 121 to receive the DMB signal when the whip antenna 121 is drawn out. The mobile communication (PCS) band antenna is realized by using the first contact 132, and always transmits/receives the mobile communication band signal regardless of whether the whip antenna 121 is pushed into or drawn out of the terminal main body.

Figure 2:
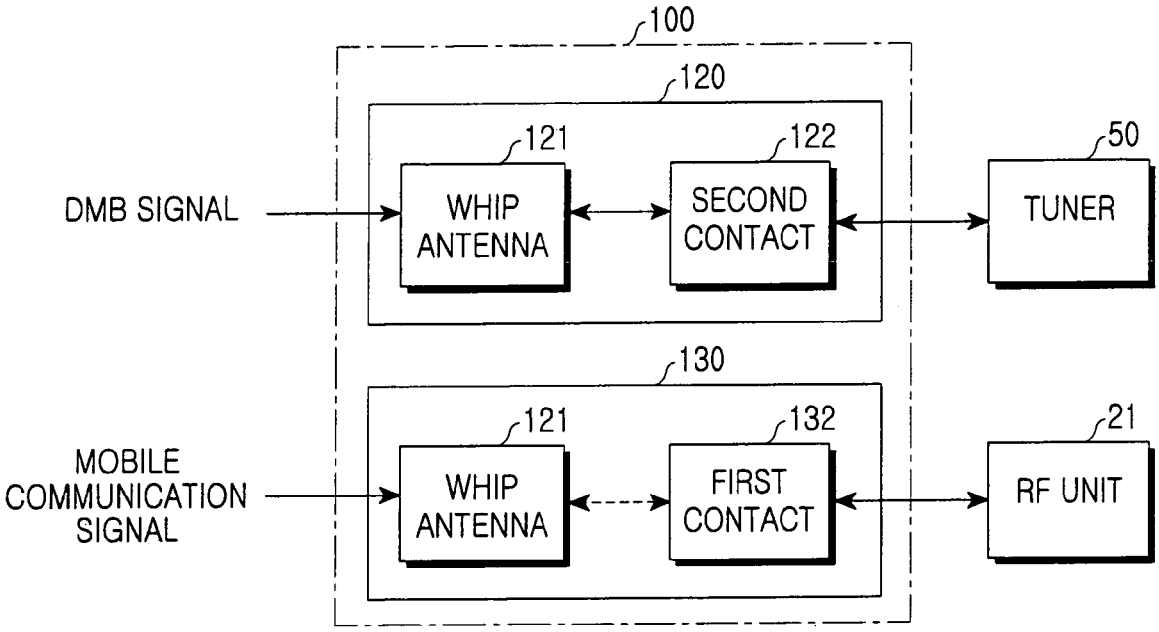
FIG. 2 is a functional block diagram of a combined DMB and mobile communication antenna apparatus for a mobile communication terminal in accordance with a preferred embodiment of the present invention.

FIG. 2 shows a functional block diagram of a combined DMB and mobile communication antenna apparatus 100 for a mobile communication terminal in accordance with a preferred embodiment of the present invention.

Referring to FIG. 2, the antenna apparatus 100 includes a DMB antenna section 120 having the whip antenna 121 (in a drawn-out state) and the second contact 122, and a mobile communication antenna section 130 having the whip antenna 121 and the first contact 132. Although the whip antenna 121 is shown as two separate whip antennas according to the reception signals of the whip antenna 121, this is only for the sake of clarity, and it is obvious that the whip antennas 121 in two separate states is a single antenna in a physical sense. As shown in FIG. 2, the whip antenna 121 of the DMB antenna section 120, which is in a drawn-out state, receives the DMB signal, and the received DMB signal is provided to the DMB tuner 50 via the second contact 122. The whip antenna 121 of the mobile communication antenna section 130 receives the mobile communication signal regardless of being in a drawn-out state or in a pushed-in state, and the received mobile communication signal is provided to the RF unit 21 via the first contact 132. In order to illustrate that the whip antenna 121 does not come in direct contact with the first contact 132, the connection state between the whip antenna 121 and the first contact 132 is designated by a dotted double arrow.

Figure 3:
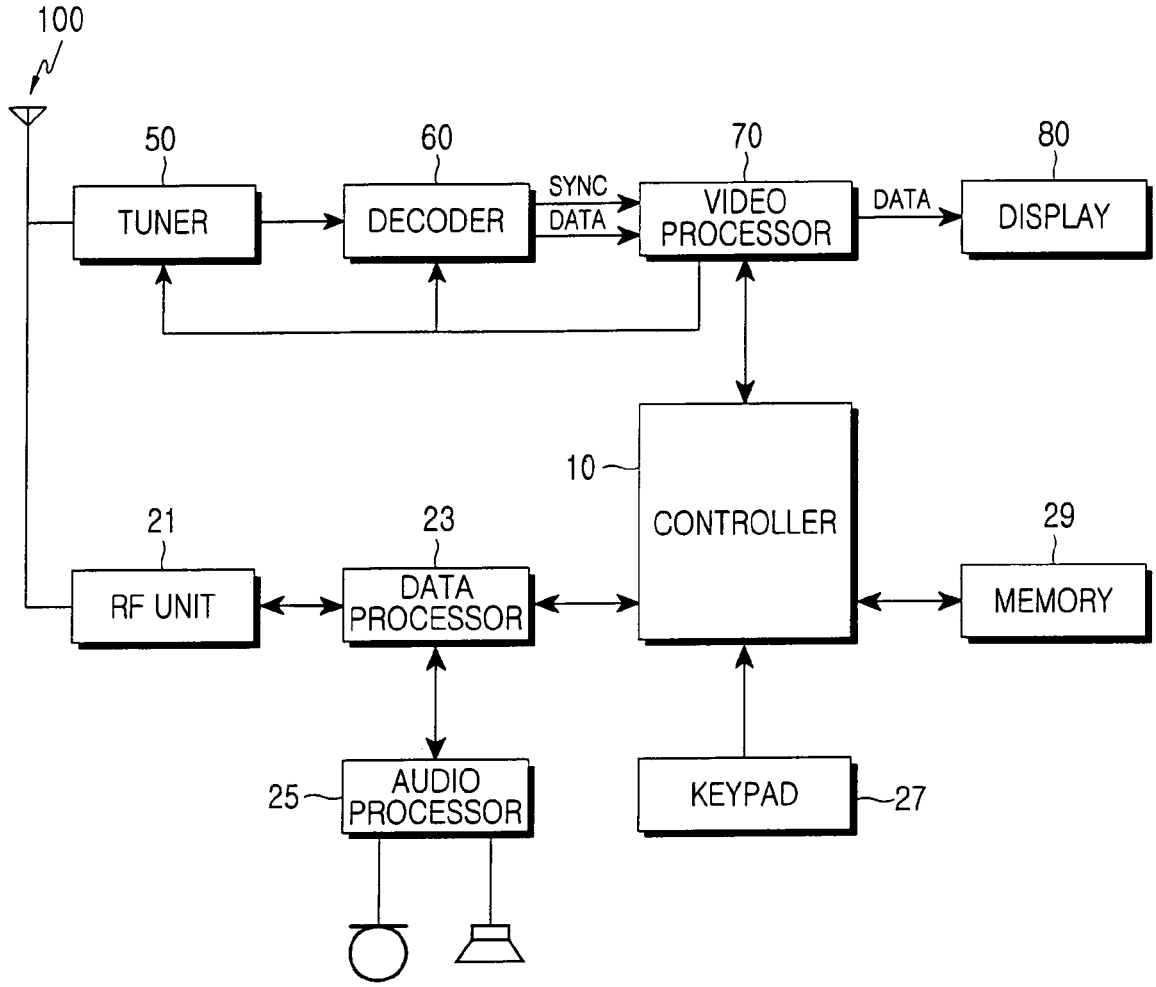
FIG. 3 is a block diagram for illustrating the overall structure of a mobile communication terminal having an antenna apparatus according to the present invention.

FIG. 3 is a block diagram showing the overall structure of a mobile communication terminal having an antenna apparatus according to the present invention.

Referring to FIG. 3, the antenna apparatus 100 has the structure as shown in FIGS. 1*a* and 1*b* in accordance with features of the present invention, and receives the DMB video signal for DMB viewing and the mobile communication signal for voice and data transmission/reception. The DMB video signal is transmitted to the DMB tuner 50 through the DMB antenna section 120 of the antenna apparatus 100. Also, when the mobile communication signal is received, the received mobile communication signal is transmitted to the RF unit 21 through the mobile communication antenna section 130 of the antenna apparatus 100.

The RF unit 21 controls the mobile communication of the mobile communication terminal. The RF unit 21 includes an RF transmitter for upwardly converting the frequency of a transmission signal and amplifying the transmission signal, an RF receiver for low-noise amplifying a received signal and downwardly converting the frequency of the received signal, and so forth. The RF unit 21 carries out the mobile communication through the communication signal received from the mobile communication antenna section 130 of the antenna apparatus 100.

A data processor 23 includes a transmitter for coding and modulating the transmitted signal, a receiver for demodulating and decoding the received signal, and the like. An audio processor 25 functions to reproduce a received audio signal outputted from the data processor 23 or to transmit a transmission audio signal generated from a microphone to the data processor 23.

A keypad 27 includes keys for inputting numeral and/or character information and function keys for setting up various functions. The keypad 27 also includes various mode setup keys for processing a DMB video signal. A memory 29 may include a program memory and data memories.

A controller 10 functions to control the overall operation of the mobile communication terminal. The controller 10 sets up a DMB mode to a video processor 70 when a mobile communication mode is changed to the DMB mode by means of the keypad 27, and controls the operation of the mobile communication terminal such that a DMB video signal received from the DMB antenna section 120 of the antenna apparatus 100 is displayed according to the set-up DMB mode. The controller 10 also controls the operation of the mobile communication terminal such that the mobile communication is carried out according to the communication signal received from the mobile communication antenna section 130 of the antenna apparatus 100.

The tuner 50 functions to receive the DMB video signal of a selected channel from the DMB antenna section, and to convert the frequency of the received DMB video signal under the control of the controller 10. A decoder 60 functions to demodulate and decode the DMB video signal outputted from the tuner 50. The decoder 60 also decodes a television video signal to output color signals (such as red, green and blue, R, G, B, respectively) and synchronizing signals (horizontal synchronizing signal and vertical synchronizing signal). The video processor 70 communicates with the controller 10, and carries out a signal processing function for displaying the DMB video signal outputted from the decoder 60 under the control of the controller 10.

The video processor 70 functions to process the video signal outputted from the decoder 60 and user data outputted from the controller 10 and output the video signal and the user data in corresponding regions of a display 80. The video processor 70 outputs the DMB signal processed in a frame size, and outputs the DMB video data and the user data separately from each other.

The display 80 displays data outputted from the controller 10 in the mobile communication mode, and displays the DMB video data and the user data outputted from the video processor 70 in corresponding regions, respectively in the DMB mode. In the DMB mode, the display 80 displays the DMB video signal in a first display region, and displays the user data in a second display region. Here, the display 80 may be realized by a liquid crystal display (LCD) and, at this time, the display 80 may include an LCD controller, a memory for storing video data, an LCD display device and the like.

As described above, according to the present invention, the DMB antenna and the mobile communication antenna are integrated with each other, which is favorable for miniaturization and mobility of the mobile communication terminal.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A combined digital multimedia broadcasting (DMB) and mobile communication antenna apparatus for a mobile communication terminal, the apparatus comprising:

a whip antenna for receiving both signals in a DMB frequency band and in a mobile communication frequency band at an extended state that the whip antenna is extended from a terminal main body of the mobile communication terminal, and for receiving a signal in the mobile communication frequency band at a retracted state that the whip antenna is pushed into the terminal main body;

a first contact being indirectly coupled to the whip antenna to receive the signal in the mobile communication frequency band from the whip antenna at both the extended state and the retracted state; and a second contact being located under the first contact within the terminal main body and contacting a lower end of the whip antenna to receive a signal in the DMB frequency band at the extended state.

2. The antenna apparatus as claimed in claim 1, further comprising an inner fixing housing indirectly coupling the first contact and the whip antenna at both the extended state and the retracted state.

3. The antenna apparatus as claimed in claim 2, wherein the inner fixing housing is interposed between the first contact and the second contact.

* * * * *